United States Patent [19]

Boldrini et al.

[11] Patent Number: 4,962,634

[45] Date of Patent: Oct. 16, 1990

[54] MACHINE FOR PACKING CIGARETTES IN HARD FLIP TOP PACKS

[75] Inventors: Fulvio Boldrini, Ferrara; Antonio Gamberini, Bologna, both of Italy

[73] Assignee: G.D. Societa per Azioni, Bologna, Italy

[21] Appl. No.: 442,908

[22] Filed: Nov. 29, 1989

[30] Foreign Application Priority Data

Nov. 30, 1988 [IT] Italy ..... 3681 A/88

[51] Int. Cl.[5] ..... B65B 19/02

[52] U.S. Cl. ..... 53/234; 53/225; 53/207

[58] Field of Search ..... 53/461, 462, 466, 225, 53/207, 234; 198/476.1

[56] References Cited

U.S. PATENT DOCUMENTS

| | | | |
|---|---|---|---|
| 3,175,702 | 3/1965 | Banyas | 198/476.1 |
| 4,367,618 | 1/1983 | Focke | 53/234 |
| 4,408,435 | 10/1983 | Sutton | 53/234 X |
| 4,511,027 | 4/1985 | Zamzoni | 198/476.1 |
| 4,823,536 | 4/1989 | Manservigi | 53/234 |

*Primary Examiner*—John Sipos

*Attorney, Agent, or Firm*—Marshall, O'Toole, Gerstein, Murray & Bicknell

[57] ABSTRACT

A machine for packing cigarettes in hard flip-top packs, whereby flat hard pack blanks and preformed groups of unpacked cigarettes are fed, the former on a continuous feed line and the latter on an intermittent feed line, to a first and second station respectively, for loading a continuously rotating packing wheel; and whereby the packs formed on the packing wheel are unloaded off the same at an unloading station via an intermittent unloading line; the packing wheel presenting a number of seats, each designed to receive a blank and a respective preformed group, and each being connected to a rotary drum on the packing wheel via a respective articulated support, the configuration of which is controlled by fixed cams in such a manner as to feed the respective seat at constant speed through the first loading station, and to temporarily stop the respective seat at both the second loading station and the unloading station.

11 Claims, 3 Drawing Sheets

MACHINE FOR PACKING CIGARETTES IN HARD FLIP TOP PACKS

BACKGROUND OF THE INVENTION

The present invention relates to a machine for packing cigarettes in hard flip-top packs.

The machines usually employed for packing cigarettes in hard flip-top packs can be classified into continuous or intermittent feed types, depending on how the cigarettes and pack components are fed along the packing line.

Despite providing for relatively high output speeds, the continuous feed type has encountered little enthusiasm on the part of manufacturers, due to the complex mechanical design and consequently higher production and maintenance costs involved, and the fact that high output speed is generally achieved at the expense of quality, especially as regards the folding of lightweight wrapping materials, such as foil, which do not lend themselves readily to continuous shaping and folding.

For all these reasons, the most commonly used cigarette packing machines are intermittent feed types, which, despite providing for a high degree of quality and reliability, present a number of structural drawbacks preventing practically any improvement in current output speed.

Said drawbacks mainly involve what is known as the "packing wheel", i.e. an intermittent feed roller or wheel supplied successively with hard pack blanks and preformed groups of cigarettes usually wrapped in foil; and the conveyor lines for feeding the blanks on to the packing wheel.

In fact, over a given maximum output speed, the acceleration and deceleration involved at each step results, on the one hand, in crushing of the preformed groups of cigarettes and the packs being formed on the packing wheel, and, on the other, in misalignment of the blanks on the conveyor feeding the same.

SUMMARY OF THE INVENTION

The aim of the present invention is to provide a machine for packing cigarettes in hard flip-top packs, and which involves none of the aforementioned drawbacks.

With this aim in view, according to the present invention, there is provided a machine for packing cigarettes in hard flip top packs; said machine comprising a packing wheel; a first and second loading station and an unloading station located along the periphery of said packing wheel; a first conveyor line for successively feeding blanks on to said packing wheel through said first loading station; a second conveyor line for successively and intermittently feeding preformed groups of unpacked cigarettes on to said packing wheel through said second loading station; and an unloading line for unloading finished packs off said packing wheel through said unloading station; characterized by the fact that said first line is a continuous feed line; and that said packing wheel comprises a drum rotating, in use, at constant angular speed about its axis; a number of pockets connected to and moving with said drum, and each designed to receive a blank and respective preformed group in said first and second loading stations respectively; an articulated support located between each said pocket and said drum; and fixed cam means connected to said articulated supports for altering the configuration of the same and moving respective said pockets in relation to said drum according to the position of said articulated supports about the rotation axis of said drum; said cam means being designed in such a manner as to:

feed each said pocket together with said drum and at substantially constant angular speed through said first loading station; and reverse each said pocket at the same angular speed but in the opposite direction to said drum in said second loading station.

Said output unit is preferably an intermittent feed unit; said cam means being designed in such a manner as to reverse each said pocket at the same angular speed but in the opposite direction to said drum in said first loading station.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
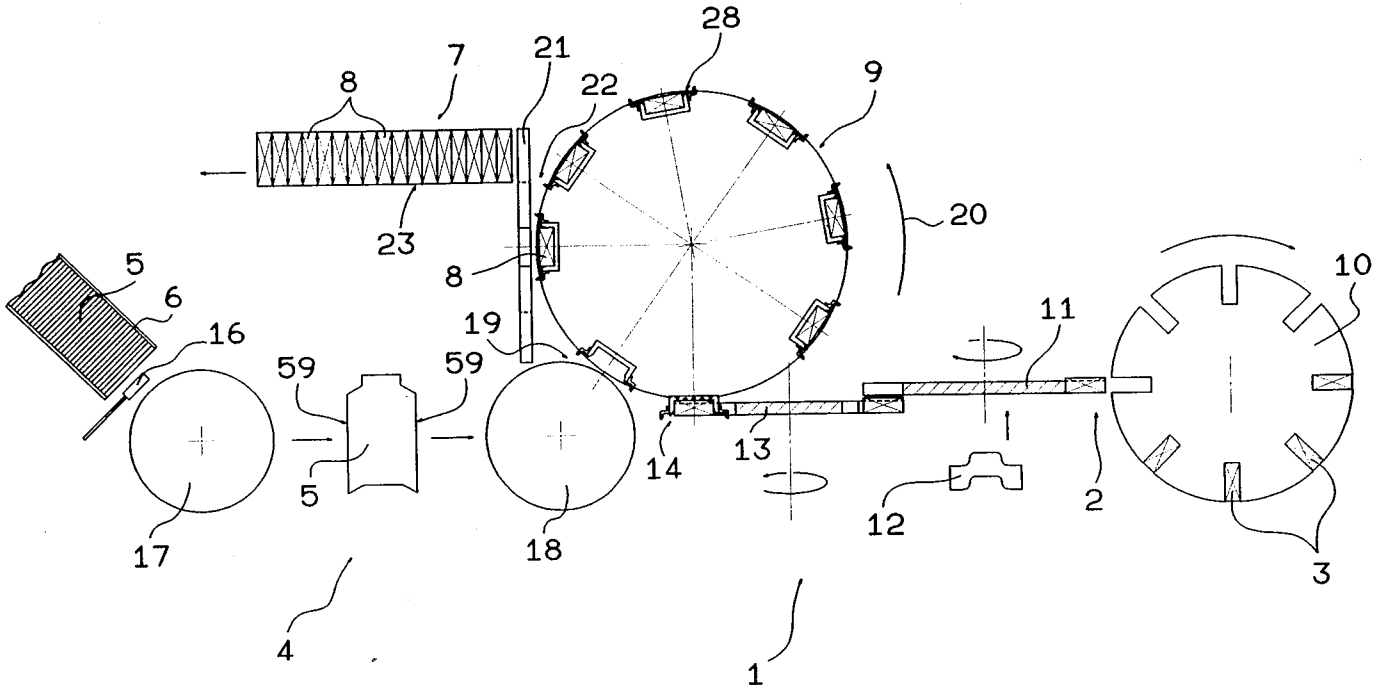
FIG. 1 shows a schematic view of a preferred embodiment of the packing machine according to the present invention.

Number 1 in FIG. 1 indicates a machine for packing cigarettes in hard flip-top packs.

Machine 1 comprises a line 2 for intermittently feeding preformed groups 3 of a given number of cigarettes (usually twenty) arranged in layers (usually three) and usually wrapped in foil.

Machine 1 also comprises a line 4 for continuously feeding blanks 5 from a box 6; an unloading line or output unit 7 for unloading finished packs B and a packing wheel 9 at two peripheral points of which converge lines 2 and 4, and from a third peripheral point of which extends line 7.

Line 2 (shown only partially in FIG. 1) comprises a known type of wrapping wheel 10 designed to rotate intermittently about a horizontal axis and transfer groups 3, via push members (not shown), on to a known type of wheel 11 rotating intermittently about a vertical axis. As they are fed intermittently about wheel 11, groups 3 are fitted successively in known manner with a strengthening collar or "inner member" 12. Line 2 also comprises a known type of intermittent conveyor or wheel 13 rotating intermittently about a vertical axis and designed to receive groups 3 from wheel 11 and feed them on to packing wheel 9 along a route substantially tangent to wheel 9 in loading station 14, wherein the periphery of wheel 13 is located, in known manner, beneath the periphery of wheel 9 for enabling a vertical push member 15 (FIGS. 2 and 3) to extract groups 3 in known manner and axially in relation to wheel 13, and feed them radially on to wheel 9.

In addition to box 6, line 4 also comprises a known type of extractor 16 for successively extracting blanks 5 from the bottom end of box 6 and feeding them on to the periphery of a feed roller 17 turning continuously about a horizontal axis. By means of a number of known feed devices (not shown), blanks 5 are transferred continuously and successively on to an output roller 18 turning at constant angular speed about a horizontal axis, and designed to transfer blanks 5 successively on to wheel 9 in a loading station 19 located upstream from loading station 14 in the rotation direction of wheel 9 shown by arrow 20. At station 19, wheel 18 is arranged substantially tangent to the outer periphery of wheel 9, and turns at substantially the same surface speed and in the same direction as wheel 9.

Line 7 also comprises a known type of wheel 21 turning intermittently about a horizontal axis perpendicular to the respective axes of wheels 9 and 13, and designed to receive packs 8 from wheel 9 at an unloading station 22 downstream from station 14 in the rotation direction of wheel 9 shown by arrow 20, and to transfer the same on to a known type of output conveyor 23. At station 22, the periphery of wheel 21 is located, in known manner, to the side of the periphery of wheel 9, to enable a horizontal push member 24 (FIG. 2) to extract packs 8 in known manner and radially in relation to wheel 9, and feed the same axially on to wheel 21.

In other words, therefore, on machine 1, groups 3 are fed intermittently on to wheel 9 at loading station 14, blanks 5 are fed continuously on to wheel 9 at station 19, and packs 8 are unloaded intermittently off wheel 9 at station 22.

Figure 2:
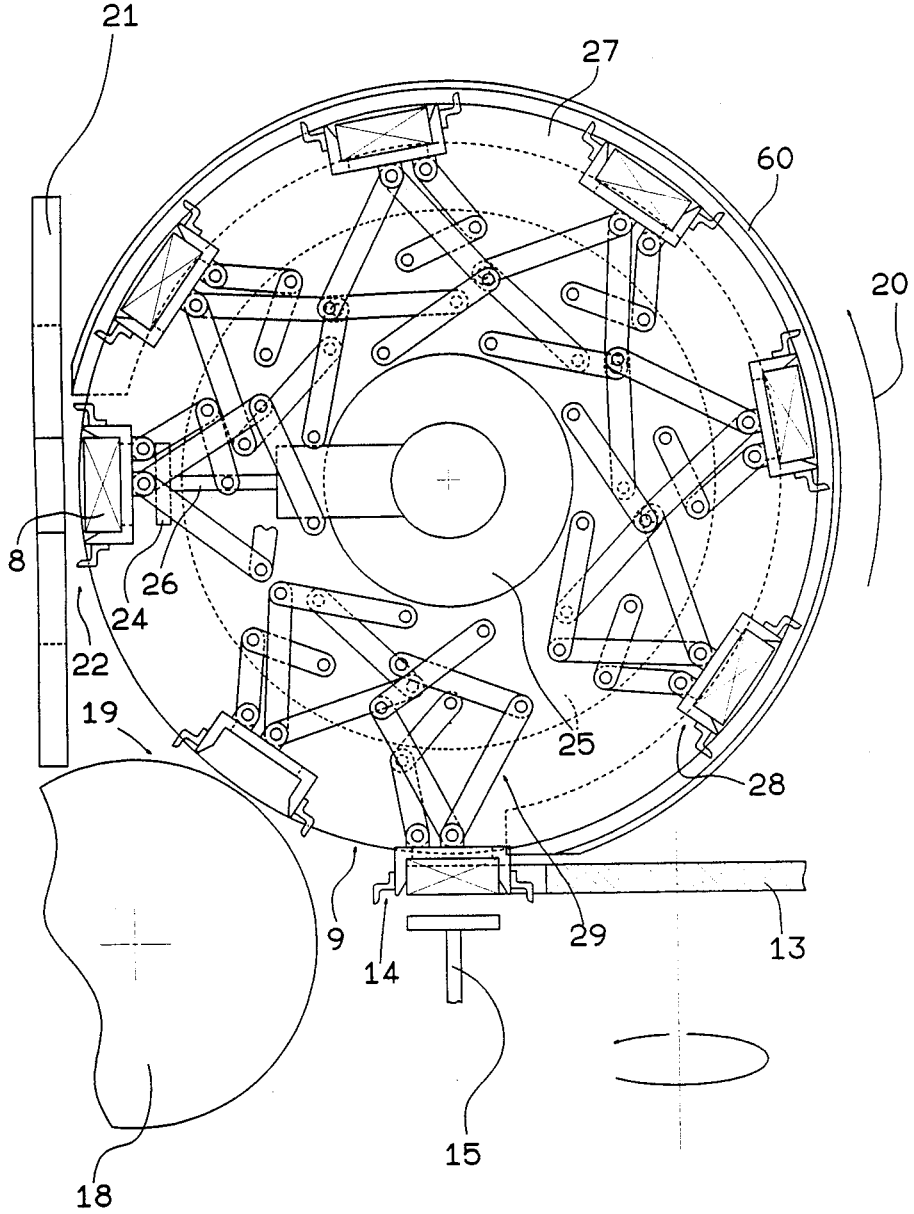
FIG. 2 shows a schematic larger-scale view, with parts removed for simplicity, of a detail on the FIG. 1 machine.

As shown, particularly in FIG. 2, wheel 9 comprises a fixed central support 25 from which extends laterally a rod 26 activating push member 24. Wheel 9 also comprises an annular element or drum 27 mounted for rotation on central support 25 and turned at constant angular speed about the axis of support 25 via known actuating means (not shown).

The outer periphery of drum 27 is fitted with substantially U-shaped pockets 28 arranged with their longitudinal axis parallel to the axis of drum 27. Each pocket 28 is connected to drum 27 by an articulated support 29, the configuration of which is controlled, as shown in FIG. 3, by three cams 30, 31 and 32 formed on a projecting portion of central support 25.

Figure 3:
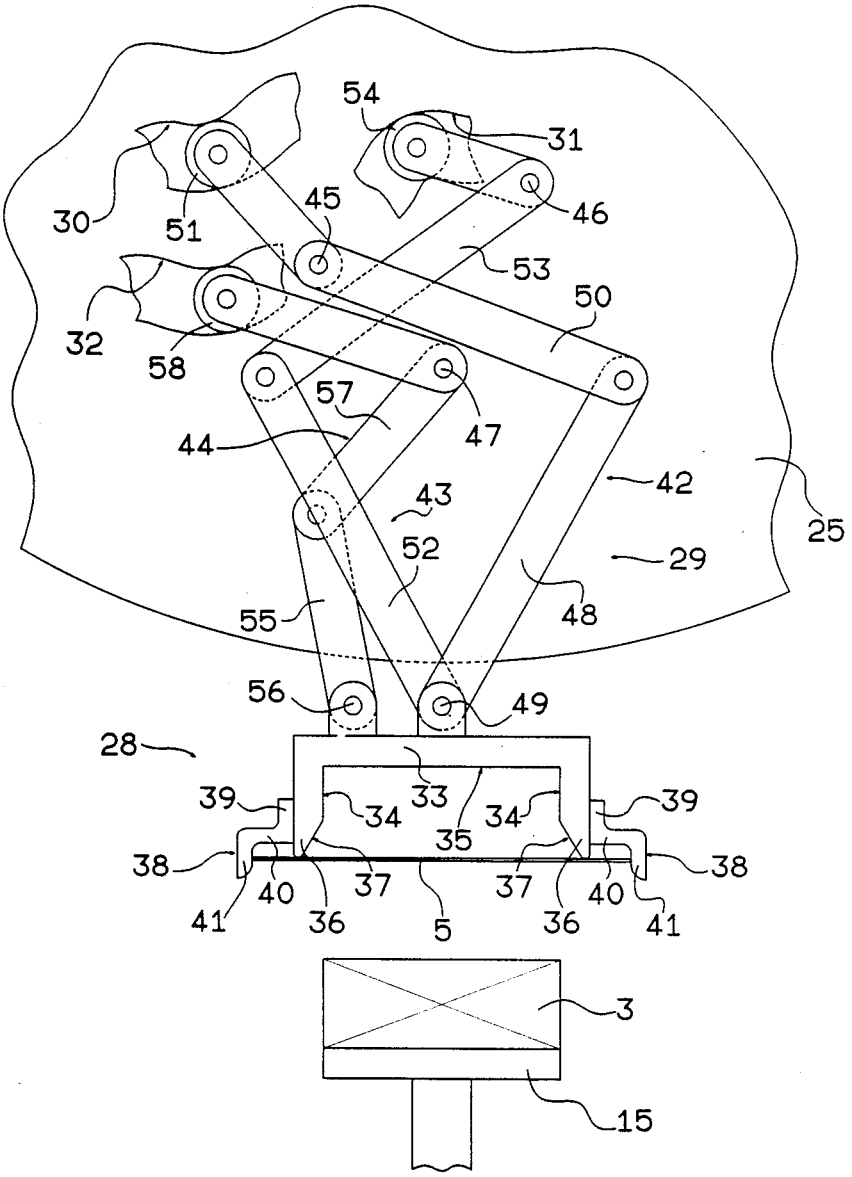
FIG. 3 shows a larger-scale view of a detail in FIG. 2.

As shown in FIG. 3, each pocket 28 comprises a bottom wall 33 facing the periphery of drum 27, and two lateral wings 34 perpendicular to wall 33 and extending outwards from lateral edges of wall 33 parallel to the rotation axis of drum 27. Together with bottom wall 33, wings 34 define a seat 35 for a respective group 3 arranged with its longitudinal axis parallel to the rotation axis of drum 27. Each wing 34 comprises an end portion 36 tapering outwards of seat 35 via an inclined lead-in surface 37. The outer surface of each wing 34 is connected integral with a bracket 38 having a substantially Z-shaped cross section and comprising a first arm 39 parallel to and connected integral with wing 34; a second arm 40 perpendicular to wing 34 and extending outwards from one end of arm 39; and a third arm 41 extending outwards from the free end of arm 40 and parallel to wing 34, with its free end located outwards, in relation to drum 27, of the free end of portion 36 of wing 34.

As shown, particularly in FIG. 3, each articulated support 29 comprises three connecting rod and crank elements 42, 43 and 44 pivoting respectively at points 45, 46 and 47 on drum 27, so as to rotate in relation to the same about respective axes parallel to the rotation axis of drum 27.

Element 42 comprises a connecting rod 48, one end of which pivots at point 49 on respective bottom wall 33 so as to rotate in relation to the same about an axis parallel to the rotation axis of drum 27, and the other end of which pivots on the free end of a first arm of a rocker arm 50 pivoting about an intermediate point 45 and comprising a second arm fitted on its free end with a cam follower 51 connected to cam 30. Element 43 comprises a connecting rod 52, one end of which pivots at point 49 on respective bottom wall 33 so as to rotate in relation to the same about an axis parallel to the rotation axis of drum 27, and the other end of which pivots on the free end of a first arm of a rocker arm 53 pivoting about an intermediate point 46 and comprising a second arm fitted on its free end with a cam follower 54 connected to cam 31.

Element 44 comprises a connecting rod 55, one end of which pivots on respective bottom wall 33 at point 56, located a given distance from point 49 of connecting rods 48 and 52, so as to rotate in relation to wall 33 about an axis parallel to the rotation axis of drum 27, and the other end of which pivots on the free end of a first arm of a rocker arm 57 pivoting about an intermediate point 47 and comprising a second arm fitted on its free end with a cam follower 58 connected to cam 32.

Consequently, by appropriately controlling the angle of rocker arms 50 and 53 about respective pivots 45 and 46 via respective cams 30 and 31, pivot 49 may be moved, in relation to drum 27, along any path and according to any law of motion, within a space substantially ranging between pivots 45 and 46 and the position that would be occupied by pivot 49 if the longer of elements 42 and 43 were to be fully extended. Moreover, by controlling the angle of rocker arm 57 about respective pivot 47, it is possible to vary, within a given angle, the inclination of wall 33 about pivot 49 and in relation to a radius of drum 27 through pivot 49

The required shape of cams 30, 31 and 32, for achieving a given displacement of each pocket 28 according to a given law of motion, may be determined by simply turning drum 27, displacing pocket 28 as required, and determining travel of cam followers 51, 54 and 58 on a disc integral with fixed support 25.

Over large part of its rotation with drum 27 and about the axis of the same, each articulated support 29 is maintained by cams 30, 31 and 32 in a fixed configuration, hereinafter referred to as the "normal configuration", wherein respective pocket 28 is positioned in a fixed "normal" intermediate position within said range in relation to drum 27, and respective wall 33 is maintained perpendicular to the radius of drum 27 through respective pivot 49.

For maintaining articulated support 29 in said normal configuration, cams 30, 31 and 32 present a circular profile concentric with the rotation axis of drum 27. With articulated support 29 in the normal configuration, respective pocket 28 travels with drum 27 as though it were integral with the same, i.e. at the same angular speed, at a constant distance from the rotation axis of drum 27, and with no change in inclination in relation to the radius of drum 27. Moreover, with articulated support 29 in the normal configuration, respective pocket 28 travels about the axis of drum 27 at the same surface speed as output roller 18 on line 4 supplying blanks 5, and along a circular trajectory substantially tangent to the outer periphery of roller 18.

Operation of machine 1 and, in particular, of wheel 9, will be described with reference to one pocket 28, commencing from when said pocket 28, with respective articulated support 29 in the normal configuration, travels through loading station 19.

At loading station 19, pocket 18 travels, as already stated, at the same speed and in the same direction as a respective blank 5, which is released in known manner from output roller 18 and engaged by pocket 28, the brackets 38 of which provide for gripping lateral edges 59 of blank 5 between arms 41.

As pocket 28, rotating with drum 27, approaches loading station 14, the normal circular shape of cams 30, 31 and 32 is so changed as to move articulated support 29 from its normal configuration and so cause pocket 28 to turn in reverse, to gradually accelerate to the same angular speed but in the opposite direction to drum 27 to stop in station 14, and, still fixed angularly, to move radially outwards for receiving, inside seat 35, a group 3 unloaded by push member 15 off wheel 13 during a pause of the same.

Said group 3 is inserted inside seat 35 by push member 15, so as to fold lateral portions of blank 5 in known manner about the same. The configuration of articulated support 29 is then gradually altered so as to cause pocket 28 to move back along the axis of push member 15 towards the axis of drum 27 which, throughout this time, has continued turning at constant angular speed. As it moves back, pocket 28 provides for counteracting the thrust on group 3, the position of which is controlled constantly throughout transfer from wheel 13 to wheel 9. The configuration of articulated support 29 is then altered continuously so as to accelerate pocket 28 and bring it back to the same position, in relation to drum 27, that it would have had if the normal configuration of articulated support 29 had never been altered.

As it travels in respective pocket 28 about the axis of drum 27 between stations 14 and 22, blank 5 engages known fixed folding members (indicated schematically by 60 in FIG. 2) which provide for folding blank 5 fully about respective group 3 and so forming pack 8.

As pocket 28 approaches station 22, the configuration of articulated support 29 is so altered as to cause pocket 28 to stop in station 22, where it is kept until rod 26 on push member 24 engages seat 35 through a hole (not shown) in wall 33, for transferring pack 8 on to wheel 21 during a pause of the same.

The configuration of articulated support 29 is then altered continuously so as to accelerate pocket 28 and bring it back to the same position, in relation to drum 27 and before reaching station 19, that it would have had if the normal configuration of articulated support 29 had never been altered, thus enabling pocket 28 to receive a further blank 5 and so repeat the packing cycle already described.

By virtue of articulated supports 29 enabling pockets 28 to be maneuvered in any manner in relation to drum 27, each pocket 28 may therefore be arrested for a given length of time at specific points about the axis of drum 27, thus enabling the use of a continuously rotating packing wheel 9, which provides for :

substantially eliminating the severe acceleration and deceleration the packs are subjected to on normal intermittent type packing wheels;

employing a continuous line 4 for supplying blanks 5, thus enabling accurate control of the position of blanks 5 prior to engagement by pocket 28;

employing a highly perfected, highly reliable known type of intermittent line 2 and, as in the example shown, an intermittent unloading line 7.

We claim:

1. A machine for packing cigarettes in hard flip-top packs; said machine comprising a packing wheel; a first and second loading station and an unloading station located along the periphery of said packing wheel; a first conveyor line for successively feeding blanks on to said packing wheel through said first loading station; a second conveyor line for successively and intermittently feeding preformed groups of unpacked cigarettes on to said packing wheel through said second loading station; and an unloading line for unloading finished packs off said packing wheel through said unloading station; characterized by the fact that said first line is a continuous feed line; and that said packing wheel comprises a drum rotating, in use, at constant angular speed about its axis; a number of pockets connected to and moving with said drum, and each designed to receive a blank and respective preformed group in said first and second loading stations respectively; an articulated support located between each said pocket and said drum; and fixed cam means connected to said articulated supports for altering the configuration of the same and moving respective said pockets in relation to said drum according to the position of said articulated supports about the rotation axis of said drum; said cam means being designed in such a manner as to:

feed each said pocket together with said drum and at substantially constant angular speed through said first loading station; and reverse each said pocket at the same angular speed but in the opposite direction to said drum in said second loading station.

2. A machine as claimed in claim 1, characterized by the fact that said output unit is an intermittent feed unit; said cam means being designed in such a manner as to reverse each said pocket at the same angular speed but in the opposite direction to said drum in said unloading station.

3. A machine as claimed in claim 1 , characterized by the fact that said cam means are designed in such a manner as to cause each said pocket, in said second loading station and during said reverse motion, to move radially back and forth in relation to said drum, between a normal back-up position and a withdrawn loading position.

4. A machine as claimed in claim 3, characterized by the fact that said line for feeding said preformed groups on to said packing wheel comprises intermittent conveying means for intermittently feeding said groups to said second loading station in a direction substantially tangent to said packing wheel; and push means connected to said conveying means, for successively engaging said groups and transferring the same, in relation to said conveying means and substantially radially in relation to said drum on said packing wheel, into respective said pockets in said withdrawn loading position; each said pocket acting as a push member for a respective said group as it moves radially into said normal back-up position.

5. A machine as claimed in claim 1, characterized by the fact that each said articulated support comprises a number of connecting rod and crank elements, each pivoting on said drum and each connected to a respective said cam means.

6. A machine as claimed in claim 5, characterized by the fact that each said connecting rod and crank element comprises a connecting rod and a rocker arm; said rocker arm comprising a first and second arm, and an intermediate pivot for connection to said drum; a first end of said connecting rod pivoting on a respective said pocket; a second end of said connecting rod pivoting on the free end of said first arm of said rocker arm; and a cam follower being fitted on said second arm and being connected to a respective said cam means.

7. A machine as claimed in claim 6, characterized by the fact that each said articulated support comprises three said connecting rod and crank elements; two of said connecting rods pivoting on a respective said pocket along the same first axis, and the third said connecting rod pivoting on said pocket along a second axis parallel to said first axis and located a given distance from the same.

8. A machine as claimed in claim 7, characterized by the fact that said first and second axes are parallel to the rotation axis of said drum.

9. A machine as claimed in claim 1, characterized by the fact that each said pocket comprises a bottom wall facing the periphery of said drum, and two lateral wings perpendicular to said bottom wall and extending outwards from lateral edges of the same parallel to the rotation axis of said drum; said wings defining, together with said bottom wall, a seat for a respective said group having its longitudinal axis parallel to the rotation axis of said drum.

10. A machine as claimed in claim 9, characterized by the fact that each said wing comprises an end portion tapered by an inclined lead-in surface.

11. A machine as claimed in claim 9 characterized by the fact that each said pocket also comprises two brackets having a substantially Z-shaped cross section, and each connected to the outer surface of a respective said wing; said two brackets defining a seat for a respective flat blank.

* * * * *